US008590755B2

(12) United States Patent
Davideit et al.

(10) Patent No.: US 8,590,755 B2
(45) Date of Patent: Nov. 26, 2013

(54) PRESSURE REGULATED FLOW VALVE WITH GAS-PISTON

(75) Inventors: Daniel E. Davideit, Manchester, NH (US); Kevin G. Verville, Deerfield, NH (US); Brian McDonald, Manchester, NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 0 days.

(21) Appl. No.: 13/510,645

(22) PCT Filed: Dec. 22, 2010

(86) PCT No.: PCT/US2010/061873

§ 371 (c)(1),
(2), (4) Date: May 18, 2012

(87) PCT Pub. No.: WO2011/079219

PCT Pub. Date: Jun. 30, 2011

(65) Prior Publication Data

US 2012/0228336 A1 Sep. 13, 2012

Related U.S. Application Data

(60) Provisional application No. 61/289,505, filed on Dec. 23, 2009.

(51) Int. Cl.
*B65D 83/00* (2006.01)

(52) U.S. Cl.
USPC ..... 222/394; 222/396; 222/402.1

(58) Field of Classification Search
USPC ..... 222/394, 396, 397, 399, 402.1, 402.21, 222/402.23; 137/505, 87.01, 87.03
See application file for complete search history.

(56) References Cited

U.S. PATENT DOCUMENTS

| | | | | | |
|---|---|---|---|---|---|
| 2,763,513 | A | * | 9/1956 | Paradise | 137/565.17 |
| 4,487,334 | A | * | 12/1984 | Werding | 222/55 |
| 4,650,094 | A | * | 3/1987 | Werding | 222/55 |
| 5,042,697 | A | * | 8/1991 | Warren | 222/402.1 |
| 5,341,968 | A | * | 8/1994 | Vandoninck | 222/396 |
| 6,070,770 | A | * | 6/2000 | Tada et al. | 222/635 |
| 6,145,712 | A | * | 11/2000 | Benoist | 222/402.1 |
| 7,721,919 | B2 | * | 5/2010 | Vanblaere et al. | 222/399 |

FOREIGN PATENT DOCUMENTS

| | | | | |
|---|---|---|---|---|
| CH | 645070 | A5 | | 9/1984 |
| JP | 8018112 | | | 4/1996 |
| JP | 8108111 | | | 4/1996 |
| JP | 8108111 | A | * | 4/1996 |
| JP | 8108112 | A | * | 4/1996 |

OTHER PUBLICATIONS

International Search Report dated Jun. 30, 2011 received in International Application PCT/US2010/061873, 5 pgs.

* cited by examiner

*Primary Examiner* — Paul R Durand
*Assistant Examiner* — Benjamin R Shaw
(74) *Attorney, Agent, or Firm* — Z IP Law PLLC; Claire Zopf

(57) ABSTRACT

A pressure regulated flow valve which compensates for the decreasing internal pressure inside a pressurized product dispensing container using substantially insoluble compressed gas. Where the internal pressure within the pressurized product dispensing container decreases below a certain threshold pressure, the pressure regulated valve provides for an increase in the flow of the product being dispensed from the pressurized container via the pressure regulated flow valve.

16 Claims, 6 Drawing Sheets

PRESSURE REGULATED FLOW VALVE WITH GAS-PISTON

CROSS REFERENCE TO RELATED APPLICATIONS

This application claims the benefit of International Application No. PCT/US2010/061873 filed Dec. 22, 2010, entitled Pressure Regulated Flow Valve with Gas-Piston and published as WO2011/079219 on Jun. 30, 2011 and of U.S. Provisional Application No. 61/289,505 filed Dec. 23, 2009 and entitled Pressure Regulated Flow Valve with Gas-Piston, which are each hereby incorporated by reference in their entirety.

FIELD OF THE INVENTION

The present invention relates to a pressure regulated flow valve including a gas piston which compensates for the decreasing internal pressure inside a pressurized product dispensing container to ensure sufficient product is ejected through the valve even as the pressure in the dispensing container falls. Where the internal pressure within the pressurized product dispensing container decreases below a certain threshold pressure, the valve via the gas piston provides for an increase in the flow of the product being dispensed from the pressurized container through the pressure regulated flow valve so as to maintain a relatively consistent flow rate of product.

BACKGROUND OF THE INVENTION

In the aerosol container industry fluorocarbons or hydrocarbons are typically utilized as the propellant in a pressurized aerosol container because these compounds are generally soluble with the product to be dispensed. These compounds remain in such a soluble state whatever amount of the product is expelled from the can thereby maintaining essentially a constant pressure within the container. In this way a constant pressure is generally available to dispense the product when the valve is actuated by a user, no matter how depleted the product in the container has become. However, due to the potential environmental harm which can be caused by the fluorocarbons and hydrocarbons to the environment, there has been increasing pressure in the market to replace the fluorocarbons and hydrocarbons with more benign propellants.

Various attempts have been made to utilize compressed gases as the propellant for dispensing the product contents of a pressurized container instead of fluorocarbons, compressed air, CO2 or N2 for example. However, one major drawback associated with utilizing a compressed gas is that these gases are generally not soluble in the product. Thus, as the product contents are gradually dispensed from the pressurized container over time, the internal pressure within the pressurized container also gradually decreases. The reduction in the internal pressure of the pressurized container significantly reduces the flow rate of the remaining product contents from the pressurized container. The pressure may even drop so low as to not be able to expel any further product from the container.

For example, with such compressed gases where a container is pressurized with an initial pressure of 100 psi of pressurized gas, such as air, the product will dispense initially at the intended flow rate from the pressurized container. However, as the product contents are gradually dispensed over time, the volume in the container for the compressed gas expands and the internal pressure of the container for forcing out the product gradually decreases to, for example, only 20 psi. As a result of this reduction in dispensing pressure, the flow rate of the remaining product also decreases and the product then has a tendency to trickle out of the valve as such product is dispensed. The significant pressure drop and decrease in product flow rate is generally unacceptable and has hindered the use of compressed gases in conventional valves and pressurized containers.

SUMMARY OF THE INVENTION

Wherefore, it is an object of the present invention to overcome the above mentioned shortcomings and drawbacks associated with the prior art dispensing valves.

An object of the present invention is to provide a valve which has a primary flow path through the valve and has an internal movable member which is regulated by the internal pressure of the pressurized container as well as the internal pressure of a gas piston so that as the internal pressure of the pressurized container falls below a threshold value, the gas piston biases the movable member in a manner which controls the expansion of the product flow path so that a desired sustained volumetric flow rate of product can continue to be emitted from the pressurized container despite the loss of internal pressure in the container.

A further object of the present invention is to change the flow path characteristics of the pressure regulated flow valve once the internal pressure inside the pressurized container falls below a predetermined threshold pressure of between about 40 to 65 psi for example, the flow path characteristics of the regulated flow valve are automatically modified so that the cross-sectional area of the flow path is modified, and an increased volume of the product is then able to be dispensed via a larger flow path area.

Another object of the present invention is to utilize a relatively environmentally harmless compressed gas, such as compressed air, CO2 or N2 as a propellant for dispensing the product contents, and thus eliminate the use of fluorocarbons, hydrocarbons and other harmful compounds as the propellant for the pressurized container.

A still further object of the present invention is to provide a pressure regulated flow valve in which the associated manufacturing and assembly costs are minimized while still providing a reliable pressure regulated flow valve which can maintain a relatively consistent flow rate both at a high internal pressure and at low internal pressure.

Yet another object of the present invention is to provide a pressure regulated flow valve in which the overall size and profile of the piston member, the internal pressure of the pressurized container and the pressure of the gas piston all interact with one another to dictate the threshold pressure at which the regulated flow valve transitions from high pressure condition to low pressure condition.

Another object of the present invention is to provide a variably sized orifice as a primary flow path between the valve housing and the movable member which can be variably sized by relative movement of the moveable member according to the relative pressure difference between the gas piston cylinder and the container.

The present invention also relates to a pressure regulated flow valve for dispensing product from a pressurized container, the pressure regulated flow valve comprising a valve housing having an upper chamber accommodating a valve stem and a lower chamber accommodating a gas piston cylinder comprising a movable piston, and a flow controller connected to the movable piston, a first pressure inside of the gas piston cylinder and a second pressure inside of the container, a passageway for dispensing variable amounts of product through the valve housing; and wherein the passageway has a variable sized opening defined by the flow controller according to a relative difference between the first and the second pressures.

The present invention also relates to a method of regulating a flow valve for dispensing product from a pressurized container, the method comprising the steps of defining a valve housing having an upper chamber accommodating a valve stem and a lower chamber accommodating a gas piston cylinder comprising, a movable piston, and a flow controller connected to the movable piston, providing a first pressure inside of the gas piston cylinder and a second pressure inside of the container, forming a passageway for dispensing variable amounts of product through the valve housing, and allowing the passageway to have a variable space created by the flow controller and determined by the second pressure inside of the container.

BRIEF DESCRIPTION OF THE DRAWINGS

The invention will now be described, by way of example, with reference to the accompanying drawings in which.

DETAILED DESCRIPTION OF THE INVENTION

Figure 1:
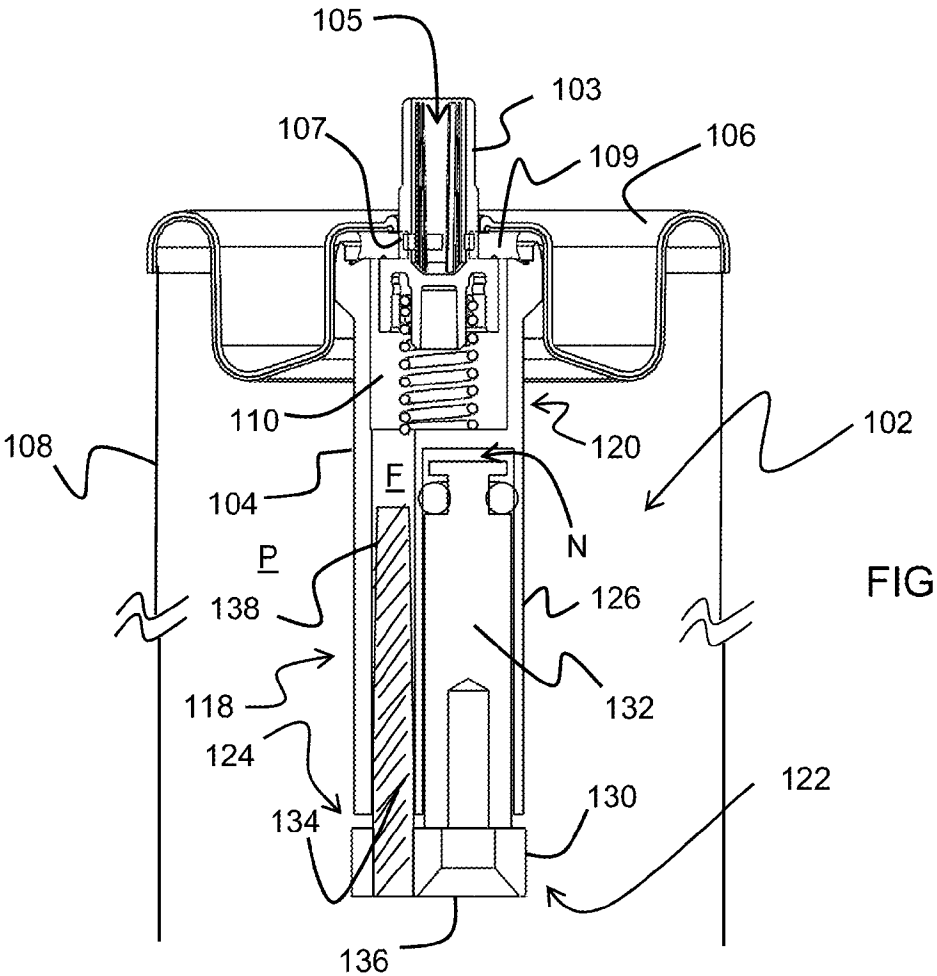
FIG. 1 is a diagrammatic cross-sectional view of a first embodiment of the regulated flow valve and gas piston, according to the present invention, shown in a high internal container pressure closed condition.

With reference to FIG. 1, a detailed description concerning various components, features and functionality a first embodiment of the present invention will now be described. The pressure regulated flow valve 102 generally comprises a cylindrical valve housing 104 which is crimped in a conventional manner to a mounting cup 106, and the mounting cup 106 is accordingly crimped in a conventional manner, to the container 108 or some other conventional pressurized container. As the general structure of aerosol containers with which the below discussed valves are compatible is generally known in the art, no further detailed discussion is provided with respect to the same.

Turning specifically to the valve 102, a valve stem 103 is supported in the housing 104 and extends through an opening in the mounting cup 106 to provide the necessary mechanical trigger and product passageway 105, for example a tilt valve stem or vertically actuated valve stem, which permits a user to eject the pressurized product from the container 108. The valve stem 103 has a top and bottom portion between which the valve passageway 105 extends and through which the product passes from the container 108 so as to be finally ejected from the top portion of the valve stem 103. A stem entry orifice 107 is generally formed in a radial relationship to the valve passage 105 in the sidewall of the valve stem 103. The orifice 107 communicates between an internal passage or cavity 110 of the valve 102 and the valve passage 105 to permit product flow into the valve passage 105 upon pressing or tilting of the valve stem 103.

A gasket 109 seals the orifice closed in an unactuated position as shown in FIG. 1, and in an actuated position (not shown), for example when the valve stem 103 is pressed downwards, the orifice 107 is moved away from this sealing position and comes into communication with the internal cavity 110 of the valve housing so that pressurized product in an internal cavity 110 is ejected through the valve stem 103 and to the outside environment. The valve stem 103, mounting cup 106, the container 108 and the arrangements and functions of these elements are generally known and thus no further discussion is provided with respect to these noted elements individually.

The valve housing 104 defines the internal cavity 110 which in turn defines a flow path F for the outgoing pressurized product as it travels from the interior of the container 108 through the housing 104 to the valve stem 103. The valve housing 104 is open at opposed upper and lower ends, with the upper end supporting the gasket 109 and stem 103 at one end thereof as described above, and as described in further detail below a pressurized product inlet at the other end including a gas piston cylinder. The internal cavity 110 is substantially cylindrical in shape and generally comprises an upper chamber portion 120 and a lower chamber portion 118. What essentially separates the upper and lower chamber portions 118 and 120 is that the lower chamber portion 118 includes the gas piston cylinder device 122 which essentially functions as a variable gateway in the valve 102 so as to ensure a consistent dispensing of product from the valve even as the internal pressure P of the container 108 drops, as will be described in detail below.

As shown, the lower chamber portion 118 in this first embodiment in FIG. 1 includes product flow path F leading from an inlet plate orifice 124 in the lower chamber portion 118 to the internal cavity 110. The flow path F is separate from the gas piston chamber N and is generally smaller in diameter than the gas piston cylinder 126, although it is to be appreciated that these diameters may be equal or different diameters depending on manufacturing processes and other design considerations. A piston mechanism 130 is provided to be inserted into the lower chamber portion 118 of the valve 102. The piston mechanism 130 comprises a gas piston 132 and a control rod 134 which are respectively received within the gas piston cylinder 126 and the lower chamber portion 118. It is this piston mechanism 130 which directly regulates what is essentially the area of the plate orifice 124 leading to the main flow path F through which the pressurized product is passing to eventually be ejected from the container 108.

In the embodiment of FIG. 1, the piston 132 and control rod 134 are substantially parallel aligned and supported by a base section 136 so that the piston 132 enters and is moveably and sealably engaged within the gas piston cylinder 126. The control rod 134, for its part, enters through the plate orifice 124 and is correspondingly slidably received within the main flow path F. The control rod 134 and the piston 132 are immovably connected and thus, due to the relative fixed connection of the piston 132 and control rod 134 by the base 136, as the piston 132 is motivated by the relative balance between the can pressure P and the internal pressure N of the cylinder 126, the control rod 134 is respectively moved axially in relation to the main flow path F and the plate orifice 124.

The control rod 134 is provided with a taper 138 along its axial length extending from a larger diameter attached to the base 136 to a smaller diameter end spaced therefrom and located within the flow path F. It is to be appreciated that this taper along the length of the control rod 134 could be consistent so that the change of area of the plate orifice 124 is essentially linear relative to the length of the control rod 134. Alternatively the taper could be variable, for example concave or convex along the length of the control rod 134, so that the change of area of the plate orifice 124 relative to the control rod 134 was non-linear The plate orifice 124 is provided with a certain diameter in relation to the control rod 134. In general, the plate orifice 124 is provided with a slightly larger diameter than the largest diameter of the control rod 134 so that there is always a minimal area or space between the outer diameter of the control rod 134 and the inner surface of the flow path F. Pressurized product is thus permitted to flow through this area or space defined by the plate orifice 124 and the immediately adjacent axial section of the control rod 134. It is to be appreciated that the taper of the control rod 134 as discussed above, determines the flow path cross-sectional area depending on where the tapered control rod 134 is axially aligned with respect to the plate orifice 124 and in effect creates a variable size opening into the flow path F. It is to be appreciated that the taper on the control rod 134 may be a linear taper, or in the alternative it may also be a convex or concave taper as shown by way of example in FIGS. 2A and 2B, or any other geometrical taper may be used which is determined to create a substantially constant product volume flow in conjunction with the pressure transition occurring in the container 108. As the piston 132 is forced out of the cylinder 126 due to pressure balancing, discussed in further detail below, consequently the control rod 134 is pulled from the plate orifice 124, the narrowing taper 138 of the control rod 134 allows more pressurized product through the plate orifice 124 and into the flow path.

The piston cylinder 126 as seen in FIG. 1 is provided with an initial charge pressure N which in conjunction with the well known pressure volume and area formula PV=nRT maintains the piston 132 in a substantially closed position, and the area of the plate orifice 124 is relatively small when the pressure P in the container is at full container pressure. The initial full can pressure Pi is of course relatively high and will force a desired volume of product through the plate orifice 124 and down the flow path F. In other words, the initial container pressure Pi maintains the base 136 and therefore the control rod 134 and piston 132 deeply inserted into the lower chamber portion of the valve body and there is a restricted area as defined by the plate orifice 124 and control rod 134 through which the product can pass.

As the pressurized product is ejected from the container 108, the initial pressure Pi in the container 108 gradually lowers to Pi−x. At a predetermined point, depending on the initial charge pressure N of the gas piston cylinder 126, Pi−x attains a pressure permitting the gas piston pressure N to gradually move the piston 132 from the substantially closed position outwards. When the piston 132 is pushed out of the cylinder 126, the entire base 136 moves as well causing the control rod 134 to move outward relative to the plate orifice 124. When the control rod 134 moves, the flow path F increases gradually in size according to the taper 138 and allows for a greater volume of product to flow from the container to the internal cavity 110 and eventually out the valve passage 105. The increase in the volume of the flow path as the pressure drops helps ensure a relatively constant flow of product is maintained from the device and compensates for the decrease in the internal pressure P.

As the internal pressure P continues to decrease past the Pi−x threshold, the piston 132 is pushed farther and farther outward by the decreasing gas piston pressure N. This will eventually result in either the piston 132 reaching a maximum outward position and thereby defining a least restrictive position of the control rod 134; or it will result in the internal pressure P reaching a state of equilibrium with the gas piston pressure N. Either way, the piston 132, and therefore the control rod 134, alters the size of the inlet plate orifice 124 between the substantially closed position as shown in FIG. 1 and a maximum outward position defining a least restrictive position and maximum opening for the product to flow out through the valve.

Figure 2A:
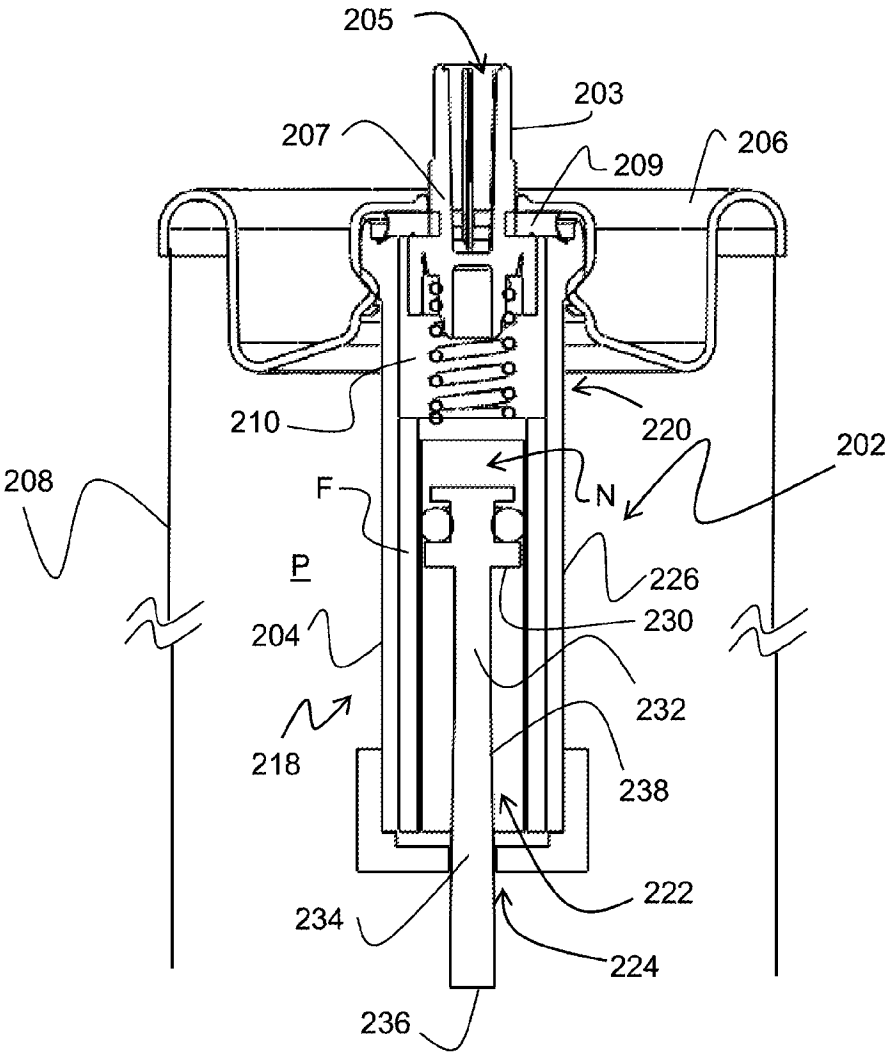
FIG. 2A is a diagrammatic cross-sectional view of a second embodiment of the regulated flow valve and gas piston, according to the present invention, shown in an initial high internal container pressure closed condition.
Figure 2B:
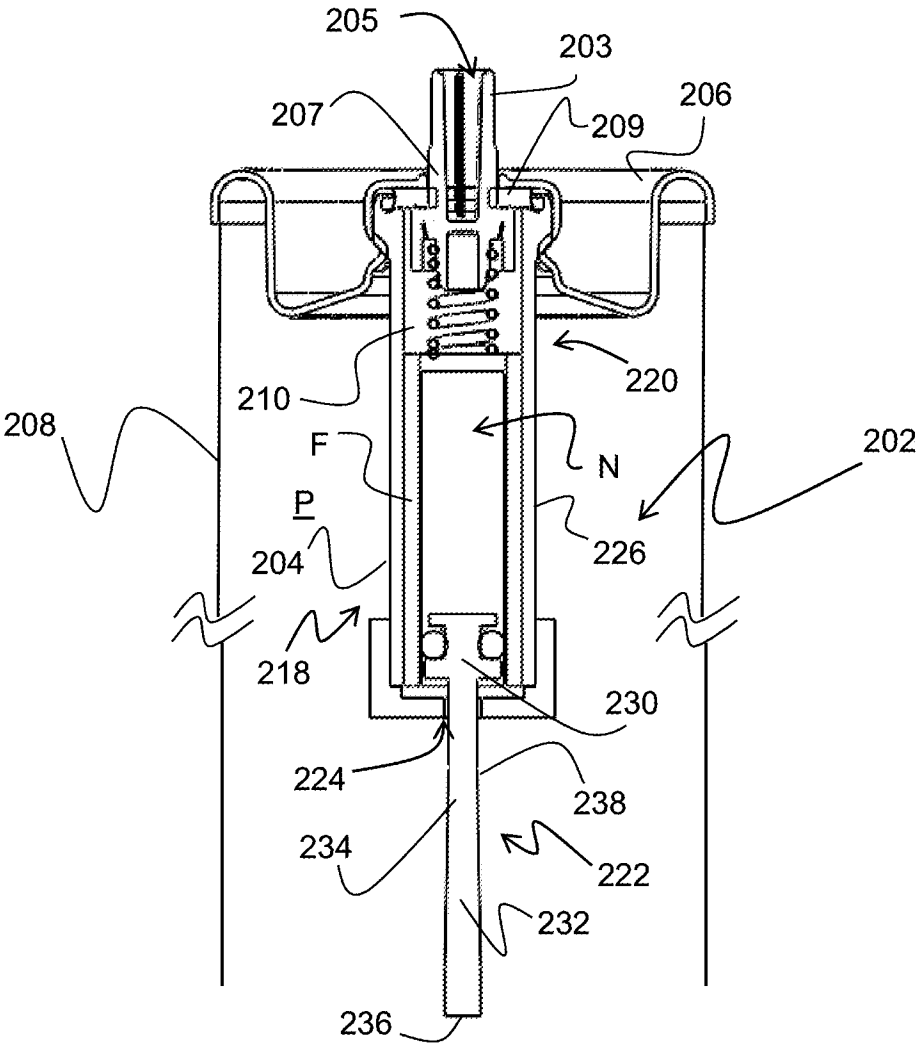
FIG. 2B is a diagrammatic cross-sectional view of the second embodiment of the valve of FIG. 2 in a low internal container pressure condition.

In a further embodiment of the present invention shown in FIGS. 2A-B, the flow control rod 234 is linearly attached to the movable piston 232 and axially aligned therewith. This embodiment shown in FIG. 2 has the flow control rod 234 extending through a plate orifice 224 provided at the bottom of the housing, which is also formed axially aligned with the piston 232, cylinder 226 and the control rod 234. The pressure inside of the container P relative to the pressure N in the cylinder 226 is still the determining force for movement of the control rod 234 and hence the size of the flow path F. The flow path F in this embodiment is generally between the housing 204 and surrounding the cylinder 226, and a slight space therebetween guides the product from the container in the same upward manner from the orifice 224 into the internal cavity 210 of the upper chamber 220 and eventually out the valve passage 205. The control rod 234 tapers in the manner as described above with respect to the first embodiment. This also allows for an increase in the area of the plate orifice 224 such that when the pressure P inside of the container decreases, the piston 232 will be moved outward by the cylinder pressure N relative to the pressure P of the container 208. As the pressure P decreases the manner in which the rod is tapered allows for smaller and smaller diameter sections of the rod 234 to pass through the orifice 224, resulting in a larger and larger area defined by the plate orifice 224 for the product to flow through. At some point, the pressure inside of the container P will be small enough that the piston 232 will reach its most outward position relative to the cylinder 226, which can be seen in FIG. 2B. This will be the least restrictive position for the control rod 234 and will allow for the largest area of the orifice 224 for product to flow through.

Figure 3A:
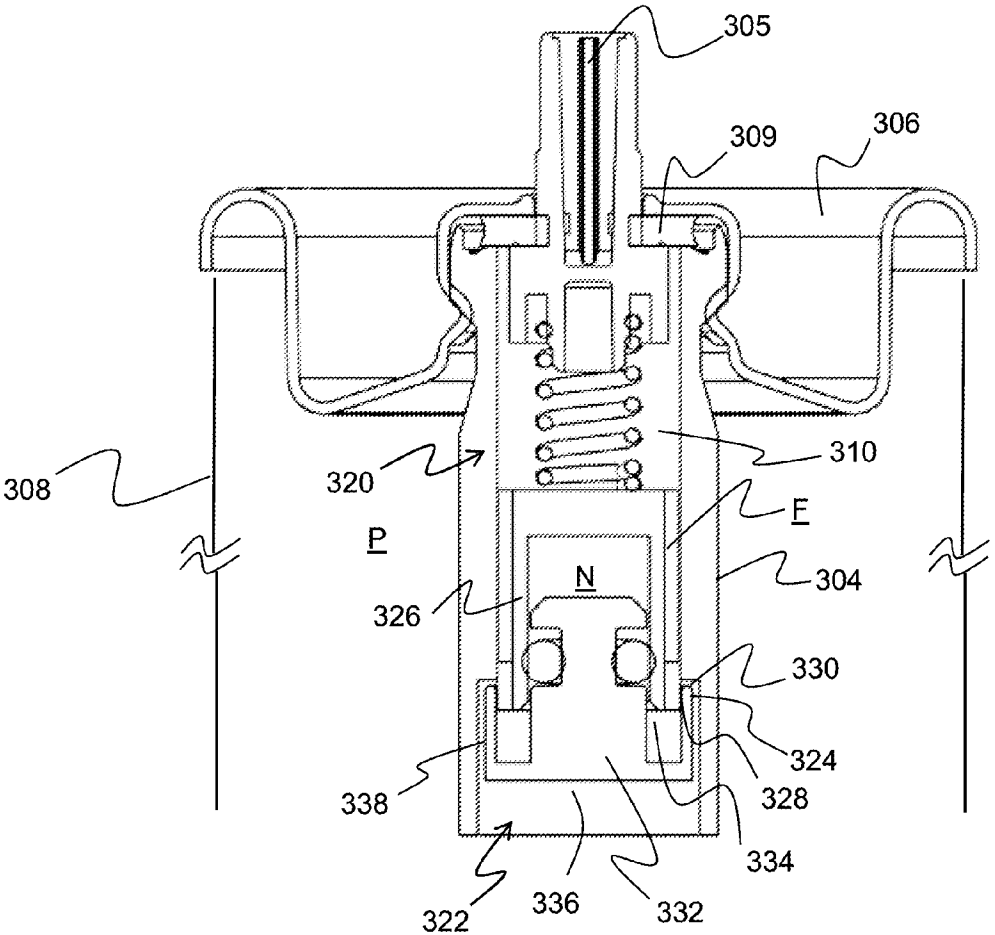
FIG. 3A is a diagrammatic cross-sectional view of a third embodiment of the regulated flow valve and gas piston, according to the present invention, shown in an initial high internal container pressure condition.
Figure 3B:
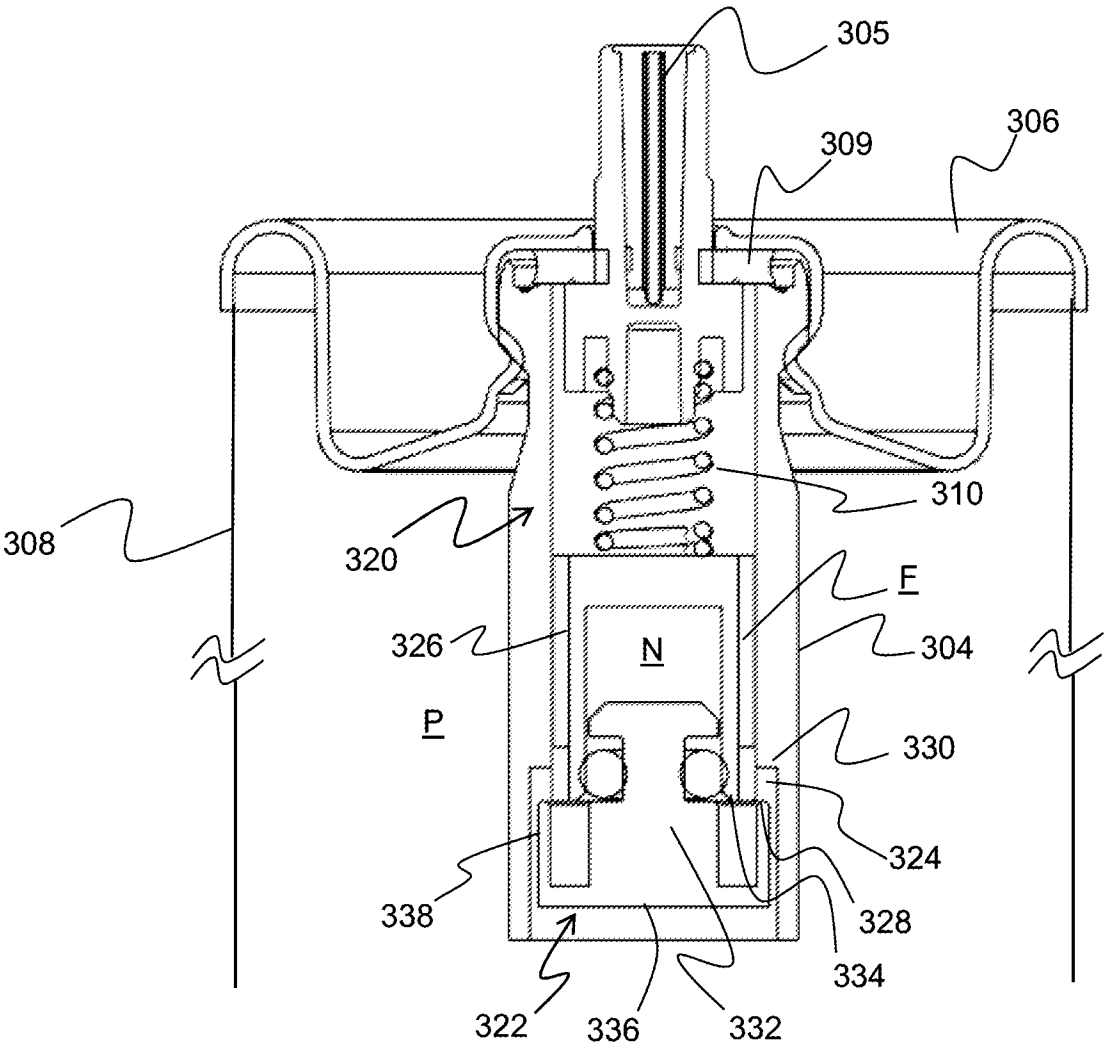
FIG. 3B is a diagrammatic cross-sectional view of the third embodiment of the regulated flow valve and gas piston shown in a low internal container pressure condition.

In a yet further embodiment of the present invention, the flow control device is no longer a rod or needle, but is instead a cylindrical cap 322 directly attached to the movable piston 332 as seen in FIGS. 3A-B. The cap 322 is formed by a base 336 extending outward to a larger diameter than the piston 332 and a cylinder wall 338 depending therefrom having a larger diameter than, and extending circumferentially around the piston 332. In this embodiment, the cylinder wall 338 has a free edge 328 which abuts with a shoulder 330 formed in the inner wall of the housing 304. A space between the free edge 328 of the cylinder wall 338 and the shoulder 330 defines the inlet orifice 324 to the valve whereby the product to be dispensed flows into according to the container pressure P. A portion of the cylinder wall 338 contacts an inner flange 334 of the cap 322 so that a minimal space is maintained even at full can pressure between the free edge 328 of the cylinder wall 338 and the shoulder 330 to permit product to enter into the valve.

This embodiment operates in a similar fashion as the previous embodiments to increase the area of the inlet orifice 324 as the container pressure P decreases. Instead of a tapered rod however, as the piston 332 moves outward due to a decrease in the pressure P inside of the container, the cylindrical cap 322 moves outward as well pulling the free edge 328 farther away from the shoulder 330 creating a larger opening and more area for the product to flow through into the valve housing and up the passage F to the upper chamber 320 and eventually out of the valve passage 305. FIG. 3A shows this embodiment with the piston 332 in the initial position with high initial pressure Pi providing only a small, or the most restrictive area through the orifice 324 for the product to flow. After a certain amount of product is expelled out of the valve passage 305 through use, the pressure in the container P accordingly decreases. As previously described, the initial pressure Pi reaches a point Pi−x such that the pressure in the gas cylinder N is enough to begin to move the piston 332 outward. This outward movement moves the free edge 328 of the cap 322 away from the shoulder 330 and creates more area in the orifice 324 which thus allows more product to flow to the upper chamber 320 despite the lower pressure Pi−x in the container. FIG. 3B shows the present embodiment with the piston 332 and cylindrical cap 322 in the substantially entirely open position providing a larger or less restrictive path for the product to flow through the orifice 324.

Figure 4:
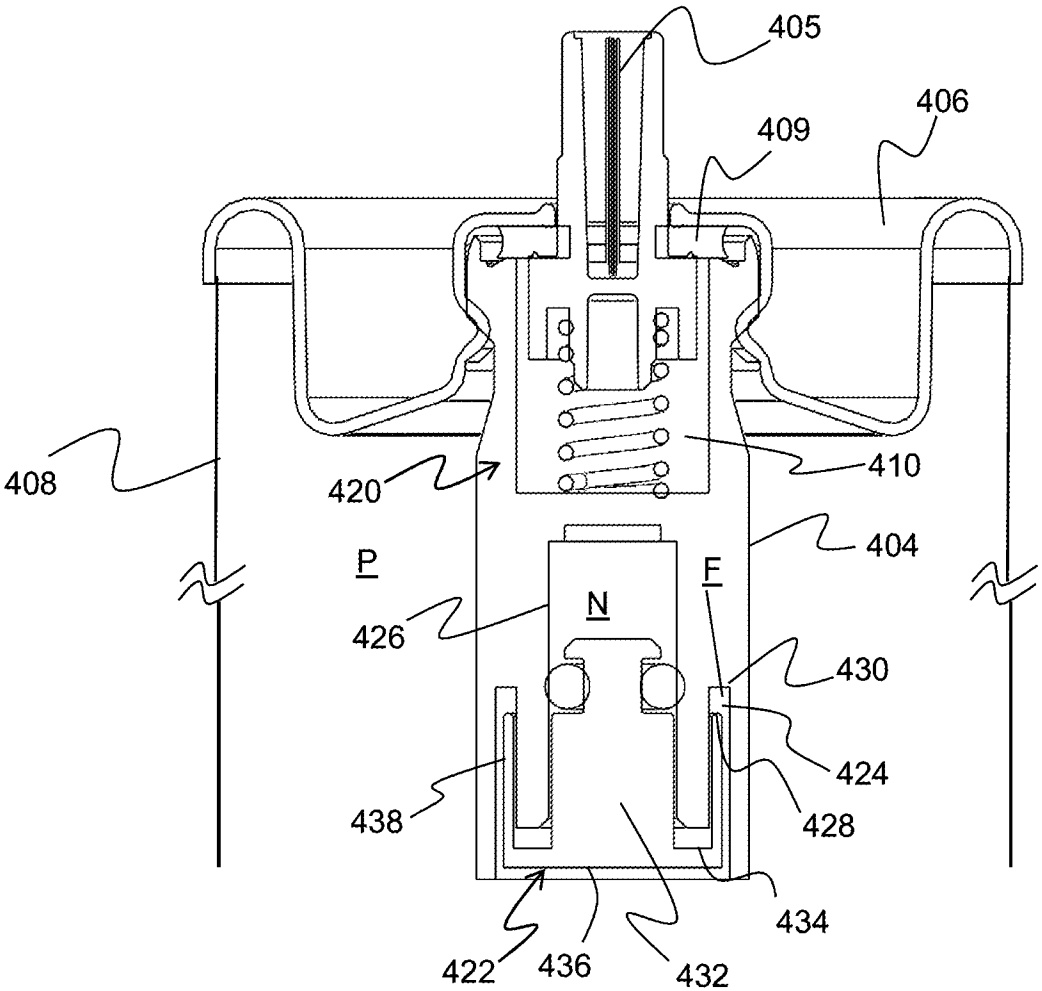
FIG. 4 is a diagrammatic cross-sectional view of the fourth embodiment of the regulated flow valve and gas piston shown in a low internal container pressure condition.

In a similar embodiment of the present invention, the cylindrical wall 438 of the cap 422 directly attached to the movable piston 432 is narrowed and extends along the housing 404 as seen in FIG. 4. A space between the free edge 428 of the cylinder wall 438 and the housing 404 and shoulder 430 defines the inlet orifice 424 to the valve whereby the product to be dispensed flows into according to the container pressure P. The extension of the cylindrical wall 438 increases the volume of flow path F. A portion of the cylinder wall 438 contacts an inner flange 434 of the cap 422 so that a minimal space is maintained even at full can pressure between the free edge 428 of the cylinder wall 438 and the shoulder 430 to permit product to enter into the valve. FIG. 4 shows this embodiment with the piston 432 and cylindrical cap 422 in the substantially open position providing a larger or less restrictive path for the product to flow through the orifice 424.

Since certain changes may be made in the above regulated flow valve, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, we claim:

1. A pressure regulated flow valve for dispensing product from a pressurized container, the pressure regulated flow valve comprising:

a valve housing within a pressurized container, the valve housing defining a product flow path and having an upper chamber accommodating a valve stem and a lower chamber accommodating a gas piston cylinder comprising:

a movable piston received within the gas piston cylinder so as to define a sealed gas piston cylinder chamber, the piston being movable between a substantially closed position and a maximum outward position;

a flow controller connected to the movable piston; and a passageway for dispensing variable amounts of product through the valve housing; and wherein the passageway has a variable sized opening defined by the flow controller according to the position of the piston within the gas piston cylinder, the flow controller increasing the size of the opening and increasing the amount of product dispensed through the passageway as the piston moves towards the maximum outward position, the position of the piston within the gas piston cylinder being dependent on a relative difference between the pressure of the gas piston cylinder chamber and the pressure of the container.

2. The pressure regulated flow valve as set forth in claim 1 further comprising an initial condition wherein the pressure of the container is at full pressure to maintain the movable piston in a starting position.

3. The pressure regulated flow valve as set forth in claim 2 wherein the starting position of the movable piston most restricts the variable space in the passageway.

4. The pressure regulated flow valve as set forth in claim 3 further comprising a final condition wherein the pressure of the container is at a minimal pressure and the movable piston is in a finishing position.

5. The pressure regulated flow valve as set forth in claim 4 wherein the finishing position of the movable piston least restricts the variable space in the passageway.

6. The pressure regulated flow valve as set forth in claim 5 further comprising an intermediate condition wherein the pressure of the container is balanced with the pressure of the gas piston cylinder chamber such that the movable piston is in between its starting and finishing position.

7. The pressure regulated flow valve as set forth in claim 6 wherein the intermediate position of the movable piston makes the variable space in the passageway in between its most and least restrictive positions.

8. The pressure regulated flow valve as set forth in claim 1 wherein the flow controller is a rod having a tapering diameter.

9. A method of regulating a flow valve for dispensing product from a pressurized container, the method comprising the steps of:

defining a valve housing within a pressurized container including a product flow path and having an upper chamber accommodating a valve stem and a lower chamber accommodating a pressurized gas piston cylinder, the gas piston cylinder having a movable piston;

connecting a flow controller to the movable piston;

biasing the movable piston within the gas piston cylinder to a position dependent on the pressure of the gas piston cylinder and the pressure of the container;

varying the volume of a product dispensing passageway based on the position of the movable piston and flow controller.

10. The method of regulating a flow valve for dispensing product from a pressurized container as set forth in claim 9 further comprising the steps of biasing the movable piston in a starting position determined by the initial full can pressure of the container and most restricting the variable space in the passageway.

11. The method of regulating a flow valve for dispensing product from a pressurized container as set forth in claim 10 further comprising the steps of maintaining the movable piston in a finishing position determined by the minimal can pressure of the container and least restricting the variable space in the passageway.

12. The method of regulating a flow valve for dispensing product from a pressurized container as set forth in claim 9 further comprising the steps of allowing the movable piston to be in an intermediate position determined by balancing the pressure of the container against the pressure of the gas piston cylinder so that the variable space in the passageway is in between the most and least restrictive positions.

13. The pressure regulated flow valve for dispensing product from a pressurized container of claim 1 further comprising one of at least compressed air, CO2 or N2 to pressurize the container.

14. The pressure regulated flow valve for dispensing product from a pressurized container of claim 1 further comprising the movable piston being tapered to act as a flow controller.

15. The pressure regulated flow valve for dispensing product from a pressurized container of claim 1 further comprising the movable piston formed as a cylindrical cap to act as a flow controller.

16. The method of regulating a flow valve for dispensing product from a pressurized container of claim 9 further comprising the step of pressurizing the container with one of at least compressed air, CO2 or N2.

* * * * *